US005271100A

United States Patent [19]

Holt

[11] Patent Number: 5,271,100

[45] Date of Patent: Dec. 21, 1993

[54] DISPOSABLE SURGICAL GOWN

[75] Inventor: Robert L. Holt, Roane County, Tenn.

[73] Assignee: Tennessee Disposable Medical Products, Inc., Wartburg, Tenn.

[21] Appl. No.: 936,140

[22] Filed: Aug. 27, 1992

[51] Int. Cl.[5] ..... A41D 13/00

[52] U.S. Cl. ..... 2/114; 2/51; 2/901

[58] Field of Search ..... 2/2, 46, 48, 49 R, 50, 2/51, 52, 75, 80, 104, 105, 106, 114, DIG. 7

[56] References Cited

U.S. PATENT DOCUMENTS

| | | | |
|---|---|---|---|
| 3,011,172 | 12/1961 | Tames | 2/51 |
| 3,803,640 | 4/1974 | Ericson | 2/114 |
| 3,868,728 | 3/1975 | Krzewinski | 2/114 |
| 4,106,120 | 8/1978 | Zurbrigg et al. | 2/51 |
| 4,171,542 | 10/1979 | Cox et al. | 2/51 |
| 4,382,303 | 5/1983 | Lunt | 2/114 |
| 4,384,370 | 5/1983 | Singer | 2/51 X |
| 4,389,734 | 6/1983 | Franz et al. | 2/114 X |
| 4,504,977 | 3/1985 | King et al. | 2/DIG. 7 X |
| 4,523,335 | 6/1985 | Scrivens | 2/114 |
| 4,535,481 | 8/1985 | Ruth-Larson et al. | 2/114 |
| 4,622,699 | 11/1986 | Spriggs | 2/114 |
| 5,033,115 | 7/1991 | Bowling et al. | 2/48 X |

*Primary Examiner*—Clifford D. Crowder

*Assistant Examiner*—Jeanette E. Chapman

*Attorney, Agent, or Firm*—Pitts & Brittian

[57] ABSTRACT

An improved disposable surgical gown 10 comprising a body shielding panel 12 and sleeves 26, the body shielding panel 12 having a front portion 14 and side portions 16. The front portion 14 further defining a protection region 18 defines a fluid absorbent outer layer 20, a fluid impermeable barrier layer 22 and a fluid absorbent inner layer 24. The fluid absorbent outer layer 20 absorbs blood and other fluids of the like, thus hindering such fluids from dripping off the gown, the inner layer 24 absorbs perspiration, the barrier layer 22 serves as a barrier through which fluids can not permeate. In the preferred embodiment, the protection region 18 is fabricated from a trilaminate material wherein the outer layer 20, inner layer 24, and barrier layer 22 are bonded. The sleeves 26 define a fluid impermeable barrier layer 30 and a fluid absorbent inner layer 28. The barrier layer 30 serves to protect a surgeon's arms from contact with outside fluids and the inner layer 28 absorbs perspiration at the arms. In the preferred embodiment, the sleeves 26 are fabricated from a bilaminate material wherein the barrier layer 30 and the inner layer 28 are bonded. The bilaminate material, while being fluid impermeable, is also flexible such that the surgeon's motions are not substantially impeded.

2 Claims, 2 Drawing Sheets

FIG. 1
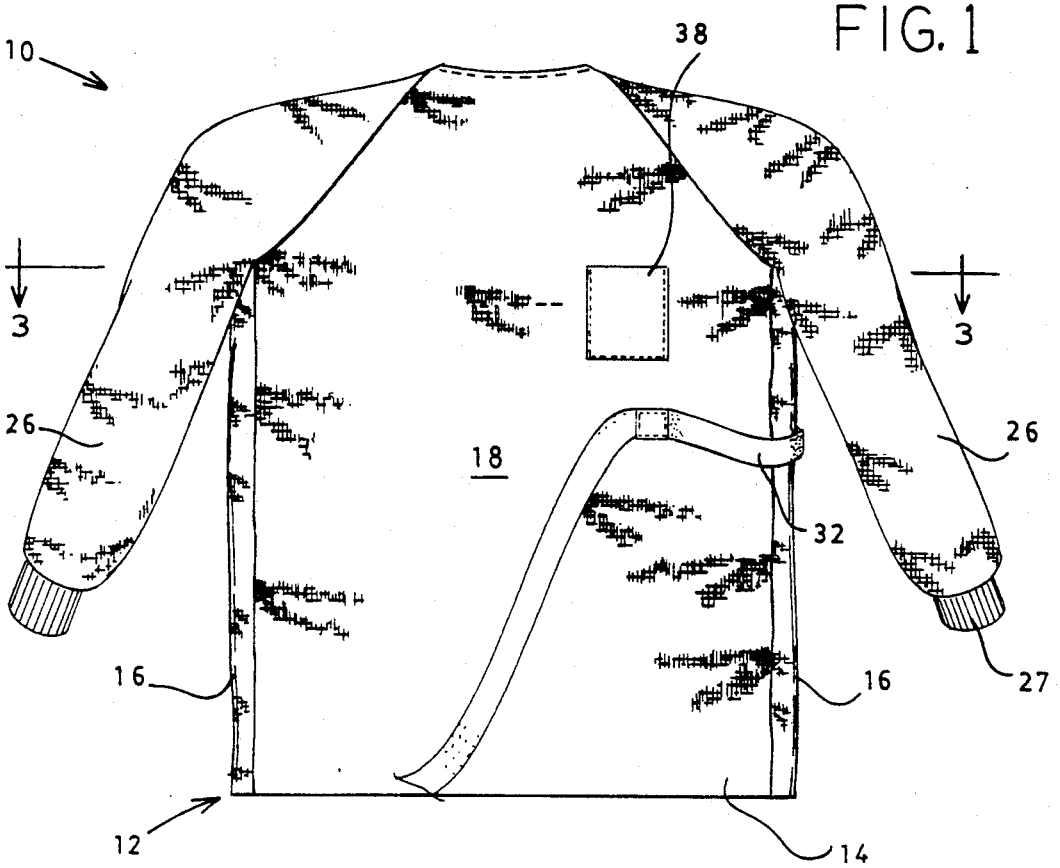
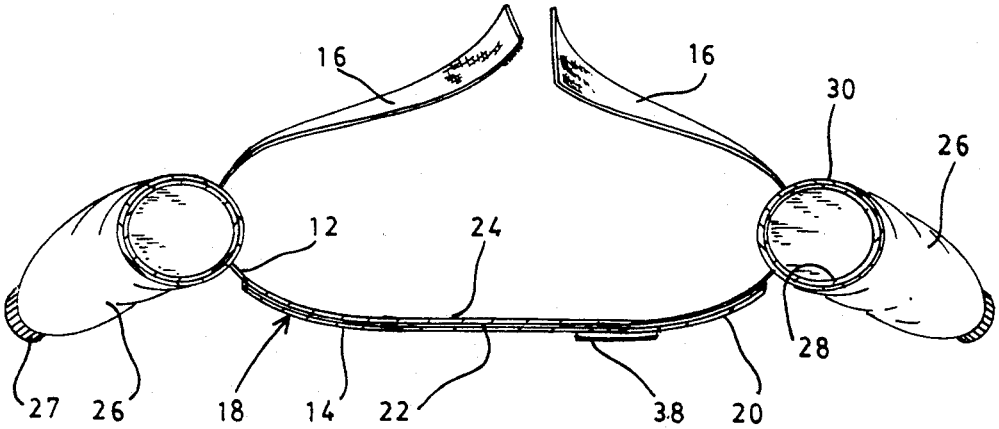
FIG. 3

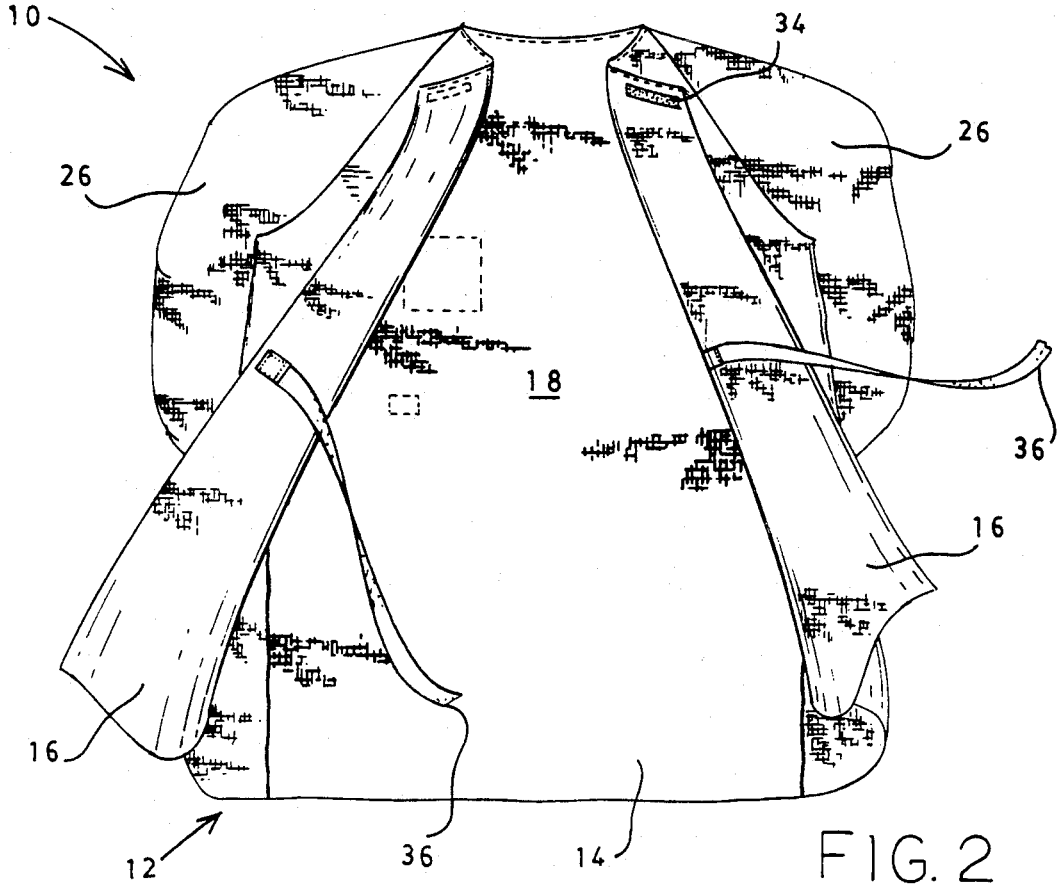
FIG. 2
FIG. 4
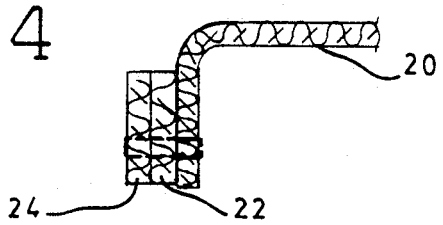
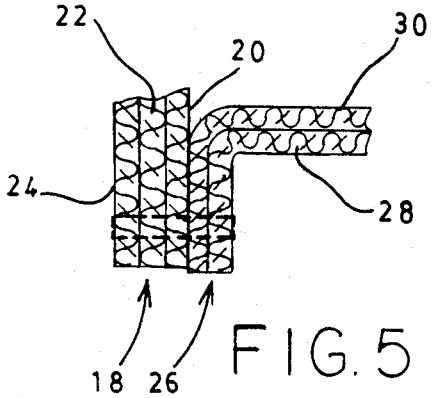
FIG. 5

DISPOSABLE SURGICAL GOWN

FIELD OF INVENTION

The present invention relates to disposable surgical gowns and, in particular, to disposable surgical gowns that are fluid impermeable to blood, serums and fluids of the like and air permeable to provide ventilation to the surgeon.

BACKGROUND ART

Presently, there are several types of disposable surgical gowns being offered to the medical community. The surgical gowns of the most recent known art attempt to resolve the problem of fluid penetration or "strikethrough" of the fabric of the gown, while retaining air permeability and flexibility for maintaining a sufficient comfort level for the surgeon.

Strikethrough of blood, serum or the like has become a major concern in recent years. Because the arms and the front of the body of the surgeon are the most susceptible to strikethrough, special efforts are made to enhance these areas with a higher degree of fluid impermeability.

Typical of the known background art are the patents listed in the following table.

| U.S. Pat. No. | Inventor | Date |
|---|---|---|
| 3,011,172 | D. Tames | December 5, 1961 |
| 4,171,542 | L. A. Cox | October 23, 1979 |
| 4,408,357 | M. A. Toth | October 11, 1983 |
| 4,504,977 | M. K. King | March 19, 1985 |
| 4,586,196 | R. N. White | May 6, 1986 |

U.S. Pat. No. 3,011,172 discusses a surgical gown with moisture proof conductive grounding means. The gown itself is made entirely of a lightweight material such as linen, cotton or the like. A panel of a moisture proof, electrically conductive material, such as synthetic rubber made electrically conductive by carbon impregnation, is sewn into the upper front portion of the front panel. The only portion of the gown that is fluid resistant is the portion of the front panel where the moisture proof panel is located.

U.S. Pat. No. 4,171,542 describes a surgical gown with a bib forming a hand support. The bib is attached to the inside of the gown's front panel, with slits cut into the gown front for access to the hand support. The bib is constructed of a fluid impervious film that is adhered to the inside of the front panel such that there is a pocket for the hand support. This portion of the gown is air and fluid impermeable.

U.S. Pat. Nos. 4,408,357, 4,504,977 and 4,586,196 discuss disposable surgical gowns with zones that are fluid resistant and zones that are air permeable for the comfort of the surgeon. The '357 patent is comprised of a front panel, two back panels and sleeves, the sleeves of which are fabricated from a water repellant material, the back panels are fabricated from an air permeable material and the front panel can be fabricated from either the material used for the sleeves or the material used for the back panel.

The '977 patent describes a zoned surgical gown wherein a front portion, the central operative region, of the front panel and the lower half of the sleeves are water resistant. The remainder of the gown is fabricated from a lightweight air permeable material. The lower half of the sleeves are comprised of a layer of a base sleeve material and a layer of a water-repellant, air porous nonwoven fabric web.

The 196 patent teaches a gown in which the back panels and the upper portion of the sleeves are highly air permeable, the front panel and lower portion of the sleeves are fluid impermeable.

The known background art attempts to solve the problems of fluid resistance while maintaining air permeability for comfort to the surgeon. To attain a high degree of fluid impermeability in the surgical gown, comfort to the surgeon is often relinquished and no alternatives are supplied to relieve the problems that result such as perspiration or inflexibility due to treatment of the material for fluid impermeability.

Therefore, it is an object of this invention to provide a disposable surgical gown which provides comfort to the surgeon through highly air permeable materials.

It is a further object of this invention to provide such a surgical gown which provides an absorbent layer to absorb perspiration where the air permeability of the material is reduced.

It is yet a further object of this invention to provide such a surgical gown that provides a flexible material that is also fluid impermeable.

Still, a further object of this invention is to provide such a surgical gown which provides overall protection to the surgeon from penetration of blood and other fluids to the body of the surgeon.

A further object of this invention is to provide such a surgical gown which provides an absorbent layer which hinders fluids from dripping down the gown and onto the surgeon's shoes or the floor.

DISCLOSURE OF INVENTION

In accordance with the present invention a disposable surgical gown is provided which offers fluid impermeability, air permeability, flexibility, a fluid absorbent inner layer to absorb perspiration that may result from reduced ventilation and a fluid absorbent outer layer to absorb blood and other fluids to hinder these fluids from dripping down the gown and on the shoes of the surgeon. The surgical gown is comprised of a body shielding panel, sleeves, which are attached to the body shielding panel, and means for securing the gown on the user. The body shielding panel is comprised of a front portion, which defines a fluid impermeable protection region, and side panels. In the preferred embodiment, the body shielding panel is constructed of a nonwoven material which is air permeable and fluid absorbent. In the preferred embodiment, the protection region is a fabricated from a trilaminate. The protection region is formed by adhering a fluid impermeable barrier fabricated from a polypropylene material to the inside of the front portion. The front portion is the outer layer of the trilaminate. The outer layer, which is fluid absorbent, serves to absorb blood or fluids of the like such that these fluids do not drip down the gown and onto the surgeon's shoes or the floor. Further, another layer of the fluid absorbent nonwoven material is bonded to the inside of the polypropylene barrier and forms the inner layer of the trilaminate. The inner layer serves to assist in absorbing perspiration from the surgeon. The barrier layer is fluid impermeable through which fluids from the inner or outer can not permeate.

In the preferred embodiment, the sleeves are constructed of a bilaminate material which is comprised of a fluid impermeable polypropylene barrier and a fluid absorbent nonwoven inner layer, the two layers are bonded together. The inner layer serves to absorb perspiration from the surgeon which may result from reduced ventilation at the sleeves. The barrier layer protects the surgeon's arms from outside fluids. The bilaminate material also offers a high degree of flexibility which allows the surgeon to move his arms freely. In the preferred embodiment, ties are supplied on the inside and outside of the gown to secure the surgical gown on the surgeon. A velcro closure is supplied for securing the gown around the neck area of the surgeon.

BRIEF DESCRIPTION OF DRAWINGS

The above mentioned features of the invention will become more clearly understood from the following detailed description of the invention read together with the drawings in which:

FIG. 1 is a perspective view of an improved disposable surgical gown constructed in accordance with several of the features of the present invention.

FIG. 2 is a rear perspective view of the improved disposable surgical gown of FIG. 1.

FIG. 3 is a cross sectional view taken along line 3—3 of FIG. 1.

FIG. 4 is a cross sectional view of the protection region.

FIG. 5 is a cross sectional view of the junction of the sleeves and the protection region.

PREFERRED EMBODIMENT OF THE INVENTION

An improved disposable surgical gown 10 which offers air permeability, fluid resistivity, flexibility and comfort is illustrated generally at 10 in FIG. 1. A rear perspective view of the surgical gown 10 is shown in FIG. 2. In the preferred embodiment, the surgical gown 10 is comprised generally of a body shielding panel 12 which is comprised of a front portion 14 and side portions 16. The front portion 14 further defines a protection region 18 which covers substantially the front portion 14 of the body shielding panel 12. In the preferred embodiment, the body shielding panel 12 is fabricated from a nonwoven material which is highly air permeable and fluid absorbent. The protection region 18 extends the length of the surgical gown 10 and laterally extends to the side portions 16 to protect substantially the front of the body of the surgeon. In the preferred embodiment, the protection region 18, a cross section of which is shown in FIG. 4, is a trilaminate. It is formed by adhering a fluid impermeable polypropylene material to the inside of the front portion 14 of the body shielding panel 12. Another layer of the fluid absorbent nonwoven material is bonded to the inside of the polypropylene material. The fluid absorbent nonwoven material of the body shielding panel 12 forms the outer layer 20 of the trilaminate, the polypropylene material forms the barrier layer 22 and the nonwoven material bonded to the inside of the barrier layer 22 forms the inner layer 24 of the trilaminate. The outer layer 20 of the gown 10 is fluid absorbent and serves to absorb outside fluids such as blood or serum and to hinder any fluid from dripping down the gown 10 and onto the surgeon's shoes or to the floor. The inner layer 24 is fluid absorbent to assist in absorbing the surgeon's perspiration which may result from reduced air permeability in the protection region 18. The barrier layer 22, which is between the inner layer 24 and outer layer 20, is fluid impermeable through which fluids from either the inner layer 24 or outer layer 20 can not permeate. The side portions 16 are secured around and on the back of the surgeon and are highly air permeable to supply for ventilation through the gown 10.

Sleeves 26 are attached to the body shielding panel 12 at an appropriate location proximate the shoulders for receiving the surgeon's arms. In the preferred embodiment, the sleeves 26 are fabricated from a bilaminate material. A cross section of the sleeves 26 and the body of the gown 10 including the protection region 18 is shown in FIG. 3. A cross section of a sleeve 26 and its connection at the protection region 18 is shown in FIG. 5. The bilaminate material is comprised of a barrier layer 30 which is fluid impermeable and an inner layer 28, which is fluid absorbent. The inner layer 28 serves to absorb the surgeon's perspiration, which may result from reduced ventilation at the sleeves 26. The barrier layer 30 serves to prevent the fluids from coming in contact with the surgeon's arms. The bilaminate material is also flexible to a degree that the surgeon can move his arms freely such that his motions are not substantially impeded by the surgical gown 10. Cuffs 27 are sewn to the bottom of the sleeves 26 to secure the bottom of the sleeves 26 to the wrists of the surgeon. In the preferred embodiment, the cuffs 27 are fabricated from a traditional elastomeric knit blend.

In the preferred embodiment, tie straps 32, 36, are affixed to the surgical gown 10 in two locations to secure the gown 10 around the surgeon. A first set of tie straps 36 are affixed to inner side of the surgical gown 10 proximate the side portions 14, as shown in FIG. 2. The oppositely disposed tie straps 36 tie at the back of the surgeon. A second tie strap 32, as shown in FIG. 1, is affixed to the outer surface of the surgical gown 10 on the front portion 14 two straps 32 extend out and wrap around opposite side of the surgeon's body and tie on the back of the surgeon.

In the preferred embodiment, a velcro closure 34 is affixed to the neck area of the surgical gown 10 and secures the neck of the surgical gown 10 around the neck of the surgeon, as shown in FIG. 2. It will be recognized by those skilled in the art that other suitable means such as an additional tie strap can be used to secure the gown 10 around the surgeon's neck. A pocket 38 can be sewn to front portion 14 of the surgical gown 10 in the preferred embodiment as shown in FIG. 1.

From the foregoing description, it will be recognized by those skilled in the art that an improved disposable surgical gown offering advantages over the prior art has been provided. Specifically, the improved disposable surgical gown is substantially fluid impermeable at the front portion and sleeves. The improved disposable surgical gown further provides a fluid absorbent inner layer at the front portion and the sleeves to absorb perspiration. The improved surgical gown also provides a fluid absorbent outer layer at the front portion to absorb blood and other fluids such that these fluids do not drip from the gown. The improved disposable surgical gown provides sleeves which are fluid impermeable while maintaining flexibility such that the surgeon's movements are not substantially impeded by the surgical gown.

While a preferred embodiment has been shown and described, it will be understood that it is not intended to limit the disclosure, but rather it is intended to cover all modifications and alternate methods falling within the spirit and the scope of the invention as defined in the appended claims and equivalents thereof.

Having thus described the aforementioned invention, I claim:

1. An improved disposable surgical gown comprising:

a body shielding panel defining a front portion and at least one side portion integral with said front portion, said body shielding panel being substantially fluid absorbent;

a protection region defined by said front portion of said body shielding panel said protection region defining an outer layer, an inner layer and a barrier layer, said outer layer being defined by said body shielding panel, said barrier layer being adhered to said body shielding panel, said inner layer being adhered to said barrier layer, said outer and inner layer being substantially fluid absorbent, said barrier layer being substantially fluid impermeable, said outer layer serving to absorbs fluids and preventing said fluids from contacting a wearer and from preventing said fluids from dripping down said surgical gown, said inner layer serving to absorb perspiration of said wearer;

sleeves fastened to said body shielding panel for receipt of said wearer's arms, said sleeves defining a barrier layer, said barrier layer being substantially fluid impermeable, and an inner layer for absorbing perspiration of said wearer, said inner layer being substantially fluid absorbent, said barrier layer being bonded to said inner layer, said barrier layer serving to protect said wearer's arms;

a belt member secured to said improved disposable surgical gown defining free ends, said free ends being selectively securable one to another in a selected fashion about a wearer's waist; and a fastening member secured at an upper location of the body shielding panel, said fastening member defining free ends, said free ends being selectively securable one to another in a selected fashion around said wearer's neck.

2. An improved disposable surgical gown defining a unitary body shielding panel defining a front panel, at least one side panel, a plurality of sleeves, at least one tie, a neck closure for securing said improved disposable surgical gown on a wearer, said improvement comprising:

a protection region defined by said front portion of said unitary body shielding panel, said protection region defining an outer layer, an inner layer and a barrier layer, said outer layer being defined by said unitary body shielding panel, said barrier layer being adhered to said unitary body shielding panel, said inner layer being adhered to said barrier layer, said outer layer and said inner layer being substantially fluid absorbent and said barrier layer being substantially fluid impermeable, said outer layer serving to absorb fluids and preventing said fluids from contacting a wearer and from preventing said fluids from dripping down said surgical gown, said inner layer serving go absorb perspiration of said wearer.

* * * * *